US005797705A

United States Patent [19]

Kellner

[11] Patent Number: 5,797,705

[45] Date of Patent: Aug. 25, 1998

[54] METHOD FOR MANUFACTURING A TUBULAR FOUNDATION IN THE GROUND

[75] Inventor: Willibald Kellner, Toni-Egger-Strasse 28, A-9990 Nussdorf-Debant, Austria

[73] Assignee: Willibald Kellner, Nussdorf-Debant, Austria

[21] Appl. No.: 730,161

[22] Filed: Oct. 15, 1996

Related U.S. Application Data

[63] Continuation of Ser. No. 75,465, filed as PCT/EP91/02394 Dec. 12, 1991, published as WO92/10637 Jun. 25, 1992, abandoned.

[30] Foreign Application Priority Data

Dec. 12, 1990 [AT] Austria ..... 2520/90
Sep. 6, 1991 [NL] Netherlands ..... 9101507

[51] Int. Cl.[6] ..... E02D 3/068

[52] U.S. Cl. ..... 405/253; 405/256; 405/271

[58] Field of Search ..... 405/271, 243, 405/245, 253, 256, 266; 175/19, 57

[56] References Cited

U.S. PATENT DOCUMENTS

| | | | |
|---|---|---|---|
| 922,106 | 5/1909 | Ducastel | 405/271 |
| 961,191 | 6/1910 | Wolle | 405/253 |
| 1,157,444 | 10/1915 | Stewart | 405/256 |
| 2,122,686 | 7/1938 | Gaty | 255/1 |
| 3,027,724 | 4/1962 | Smith | 405/245 |
| 3,245,223 | 4/1966 | Degen | 405/271 |
| 3,309,877 | 3/1967 | Degen | 405/271 |
| 3,685,597 | 8/1972 | Kostylev et al. | 175/19 |
| 3,797,586 | 3/1974 | Coyne et al. | 173/133 |
| 4,130,168 | 12/1978 | Deike | 173/38 |
| 4,148,366 | 4/1979 | Beckstrom et al. | 173/28 |
| 4,193,459 | 3/1980 | Engstrom | 173/43 |
| 4,458,765 | 7/1984 | Feklin et al. | 175/19 |
| 4,588,300 | 5/1986 | Guy | 366/114 |
| 4,697,840 | 10/1987 | Duncan | 294/119.4 |
| 4,810,020 | 3/1989 | Powell | 294/119.4 |

FOREIGN PATENT DOCUMENTS

| | | | |
|---|---|---|---|
| 351970 | 6/1928 | Belgium . | |
| 0 227 576 A2 | 7/1987 | European Pat. Off. . | |
| 0 372 225 A2 | 6/1990 | European Pat. Off. . | |
| 1230326 | 1/1959 | France . | |
| 1364218 | 5/1964 | France . | |
| 2211869 | 7/1974 | France . | |
| 2314309 | 7/1977 | France . | |
| 216258 | 10/1907 | Germany . | |
| 89 12 404.9 | 1/1990 | Germany . | |
| A-59-210124 | 11/1984 | Japan . | |
| 1535940 | 1/1990 | Russian Federation | 405/271 |
| 1535941 | 1/1990 | Russian Federation | 405/271 |
| 2000389 | 9/1993 | Russian Federation | 405/271 |
| 141248 | 10/1930 | Switzerland . | |
| 1448378 | 9/1976 | United Kingdom . | |
| 2064625 | 6/1981 | United Kingdom . | |
| 2195682 | 4/1988 | United Kingdom . | |

OTHER PUBLICATIONS

59–210124 (A) from Patent Abstracts of Japan, vol. 9, No. 80 .

*Primary Examiner*—Hoang C. Dang
*Attorney, Agent, or Firm*—Brinks Hofer Gilson & Lione

[57] ABSTRACT

A tool for making holes in the ground comprises a ram tip and coupling for connecting to a drive device, such as a hydraulically or pneumatically actuated pile driving machine, or a vibrating pile driving machine. A method for making tubular foundations in the ground comprises coupling a ram tip to a drive device, selecting a location for making a hole, placing the ram tip thereat, setting the drive device into operation to drive the ram tip into the ground to form a hole, removing the ram tip out of the hole, partially filling the hole with concrete, re-inserting the ram tip into the hole before the concrete sets, setting the drive device into operation and then removing the ram tip, thereby obtaining a tubular foundation.

6 Claims, 8 Drawing Sheets

METHOD FOR MANUFACTURING A TUBULAR FOUNDATION IN THE GROUND

This application is a continuation of application Ser. No. 08/075,465, filed Sep. 17, 1993 now abandoned, which is a 371 of PCT/EP91/02394 filed Dec. 12, 1991, published as WO92/10637 Jun. 25, 1992.

BACKGROUND OF THE INVENTION

It is known to make holes in the ground using a ground auger. Use is also made of hydraulic or pneumatic tools with a hammer tip or chisel tip which is driven with vibration or percussion.

SUMMARY OF THE INVENTION

The invention has for its object to provide means using which a hole of preselected dimensions can be made in the ground in vary simple manner, wherein, otherwise than with a ground auger, the material from the hole does not come to lie on the ground and then has to be carried away, but remains present in the ground and wherein the immediate area of the hole has undergone a considerable compacting. The invention also has for its object to provide facilities which enable use to be made for this purpose of known drive devices.

A further object of the invention is to offer provisions using which holes can be made with a very high degree of precision, even by untrained personnel.

The invention now provides a tool for making holes in the ground comprising a ram tip and coupling means for connecting to a drive device, for instance a hydraulically or pneumatically operating tool driving machine or a vibrator operating for instance with eccentrically placed rotatably drivable masses for successively exciting the ram tip in the direction of the free end by vibration or percussion.

In preference the tool has the feature that the free end of the ram tip has a first portion with a substantially conical form. A very effective force transfer onto the ground is herewith achieved, with on the one hand a desired displacement and on the other a desired compacting of the ground with the displaced ground material.

In a preferred embodiment the tool has the further feature that a second frusto-conical portion with a smaller apex angle than the first portion connects onto the conical free end. A further effective displacement of the ground is hereby performed in combination with the said compacting.

An embodiment having the feature that a third, frusto-conical portion with a smaller apex angle than the second portion connects onto this second portion has the great advantage that after making the hole it is easily removed therefrom by being retracted. The conical form, which in practice can differ relatively little from a cylindrical form, for example by a few degrees, results in the air being able to enter easily into the space between the formed hole wall and the tool.

In order to make the ram tip as light as possible the embodiment is recommended in which the ram tip is hollow.

To nevertheless give the ram tip the sufficient mechanical strength necessary to withstand the occurring excitation forces, use is preferably made of mutually connected reinforcing ribs received in the hollow ram tip. It may be useful to mechanically separate the transmission of forces from the coupling means to the free end of the ram tip from the force transmission through the wall of the ram tip. To this end the tool can have the feature that the ribs rest against the wall of the ram tip but are not connected thereto.

In a particular embodiment the tool displays the feature that a central elongate element such as a rod or a tube extends between the coupling means and the free end of the ram tip for transmitting excitation forces from the coupling means to that free end.

A possibly still greater effectiveness of the operation is achieved with an embodiment in which a mass freely movable in lengthwise direction is arranged in the ram tip. This mass does not slow the downward oriented excitation of the ram tip but can, due to its inertia, make an additional contribution to the excited percussion forces.

This variant can for instance be embodied such that the ram tip is partially filled with more or less particulate material. This material can for instance contain sand or iron, in general preferably a cheap and heavy material.

The tool preferably has the characteristic that at least the outer surface of the free end consists of a hard, wear-resistant and rugged material such as manganese steel. Other types of steel, particularly steel types rich in carbon, can also be considered suitable.

Less extreme demands are made on the second and third portions than on the first portion. The outer surfaces of the second and third portion can for instance consist of steel-52.

An embodiment for use with a drive device whereof the drive end comprises a pivot joint can preferably have the feature that the coupling means comprise a pivot joint of which the shaft lies substantially perpendicular to the shaft of the pivot joint forming part of the drive device. Thus achieved in all conditions is that the freely suspended tool makes a vertical hole in the ground. To this end the axis of the rain tip must intersect both pivot shafts. If during making of a hole in the ground the ram tip encounters an obstacle, for instance a rock, it can avoid this obstacle as a result of the cardan suspension.

In the case where no drive device with pivot joint is available, use can be made of a variant in which the coupling means take a substantially cardan form.

In a preferred embodiment the tool has the characteristic that the coupling means can be coupled to the drive device by means of a coupling block which is mechanically connected for instance by pressing, shrinking or welding to a tool such as a hammer or chisel for coupling to the drive device. With this embodiment the tool according to the invention can very easily be made suitable for use with any suitable drive device. The manufacturer of the tool can for instance acquire a hammer or chisel which fits into a drive device that a customer has at his disposal. This hammer or chisel is then connected in appropriate manner to the coupling block, which in turn has suitable coupling means available for coupling to any tool according to the invention. Thus ensured is a universal coupling of the ram tips according to the invention to any suitable drive device.

In a particular embodiment the tool displays the characteristic that the block has a transverse recess and the ram tip likewise has a transverse recess in the corresponding zone, in which recesses a coupling pin can be inserted from outside after they have been placed mutually in register. This coupling is operationally very reliable and inexpensive and has the advantage of allowing of easy disconnection into components when desired, for example for changing tool.

In a particular embodiment the tool has the feature that at least one of both recesses has a greater length axially than the coupling pin, such that the ram tip is axially displaceable to a limited extent relative to the coupling block. This embodiment can have the advantage that registering of the recesses takes place easily so that coupling can be effected more rapidly. A mechanically looser coupling can also provide the advantage that diverse components of the drive device are subjected to a smaller mechanical load.

In this respect it can be advantageous for the coacting contact surfaces of the ran tip and the coupling block to be rotationally symmetrical and for one of the said recesses to extend over the whole periphery. Thus achieved is that the tool can if desired rotate round its longitudinal axis.

The invention further relates to the coupling means as specified above and described below.

The invention also relates to a method for making holes in the ground. This method is characterized by the following steps, in appropriate sequence, of:

(1) providing a tool such as described in detail hereafter;

(2) providing a drive device such as described in detail hereafter;

(3) coupling the tool to the drive device;

(4) selecting a location for making a hole in the ground:

(5) placing the tool thereat;

(6) setting the drive device into operation such that the tool is excited with vibration or percussion at a chosen frequency in the direction of the free end of the ram tip;

(7) choosing the said frequency such that the penetration of the ran tip into the ground takes place with the highest possible output, that is, with the greatest speed with minimum energy consumption; and (8) pulling the ram tip out of the hole.

The invention also relates to a method of the type described above for manufacturing a tubular foundation in the ground. This method is characterized by the steps of:

(9) making a hole with the method as described in steps (1) through (8) above the depth of which is smaller than the depth of a tubular foundation for manufacture:

(10) partially filling the hole with pourable concrete:

(11) re-inserting the ram tip in the hole before the concrete has cured and setting the drive device into operation again such that the hole is extended to the desired depth and the concrete present therein forms a concrete tube round the ram tip and is compacted;

(12) pulling the ram tip out of the thus obtained tubular foundation.

It will be apparent that a hollow foundation of the type herewith obtained makes it possible to later remove supporting means arranged therein, should this be necessary. With the known art, wherein these supporting means are wholly incorporated into the cured concrete, later removal of the arranged construction is generally not possible.

In a particular practical embodiment the method can be characterized by

(13) performing step (9) such that the depth of the hole amounts to roughly half the depth of the finished foundation.

Easy exchangeability of supporting means is ensured with an embodiment characterized by

(14) anchoring in the tubular foundation supporting means whereof the active cross section is smaller than the cross section of the tubular foundation.

If desired the anchoring can take place by pouring in sand, gravel or other suitable filler material.

optimum use is made of the total available height in an embodiment characterized by

(15) performing the method such that the concrete extends to the top edge of the hole.

The above described method for manufacturing a tubular foundation in the ground brings about a greater compacting of the ground material in the immediate area of the hole, and therefore the later foundation, whereby the bearing capacity thereof is improved. The concrete is also pressed into the ground material whereby the cohesion between foundation and ground material is improved.

BRIEF DESCRIPTION OF THE DRAWINGS

The invention will now be elucidated with reference to the annexed drawing.

In the drawing.

DETAILED DESCRIPTION OF THE PREFERRED EMBODIMENTS

Figure 1:
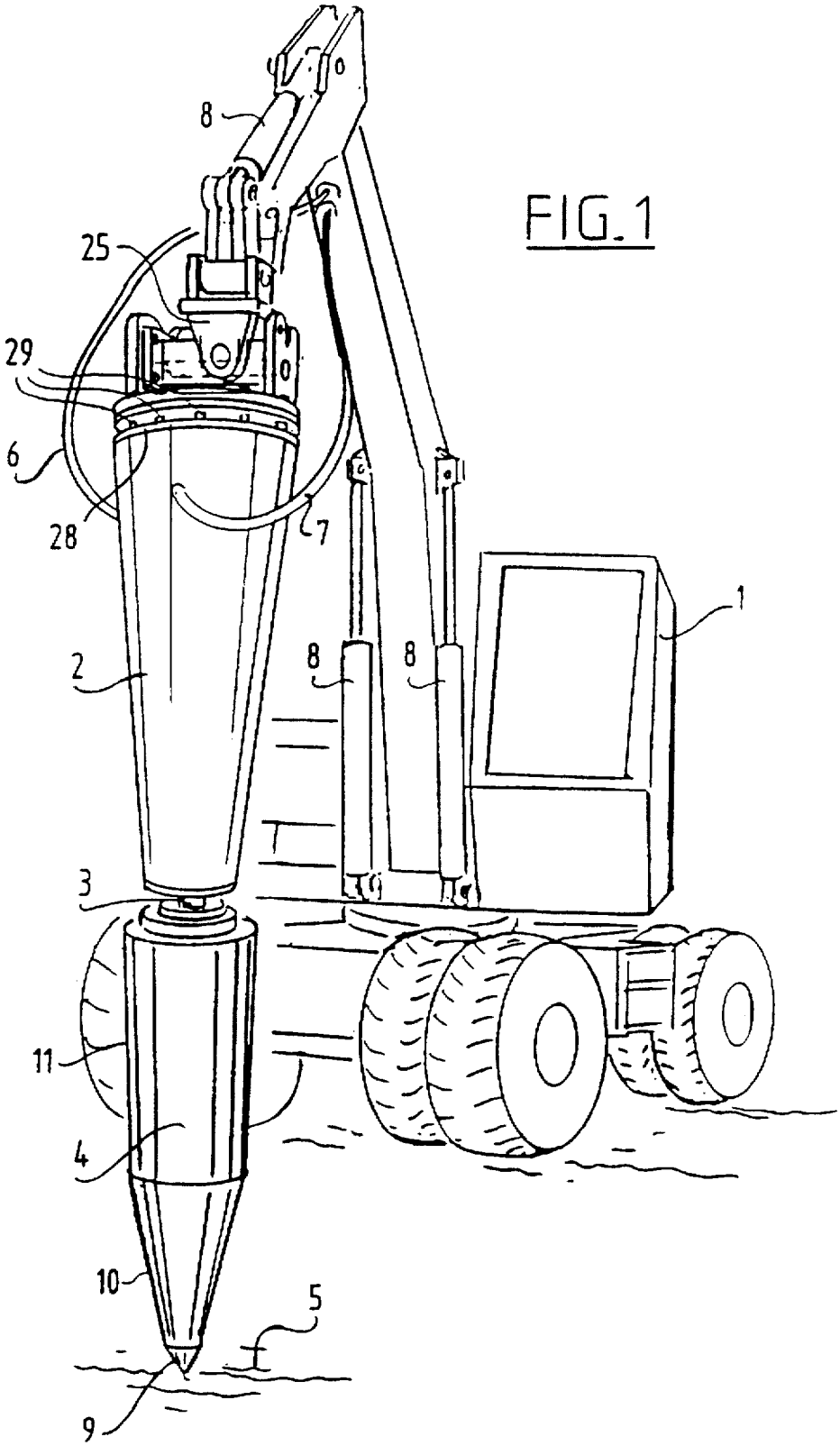
FIG. 1 shows a tool according to the invention carried by a tool driving machine.

FIG. 1 shows a lifting device 1 carrying a hydraulic tool driving machine 2. This tool driving machine 2 carries a chisel 3 which in a manner to be further described bears a ram tip 4. This is suitable for faking holes in the ground 5. The device 1 comprises a hydraulic pressure source for driving the device 2 by means of flexible hydraulic lines 6, 7 such that the chisel is excited with vibration or percussion.

To make a hole in the ground the ram tip 4 is placed at the desired position, the tool driving machine 2 is set into operation by appropriate energizing of the hydraulic source and the ram tip is moved downward while vibrating through control of the hydraulic lifting cylinders generally designated with 8. The ground material is hereby displaced, thus creating a hole, the immediate area of which has undergone a considerable compacting.

Figure 2:
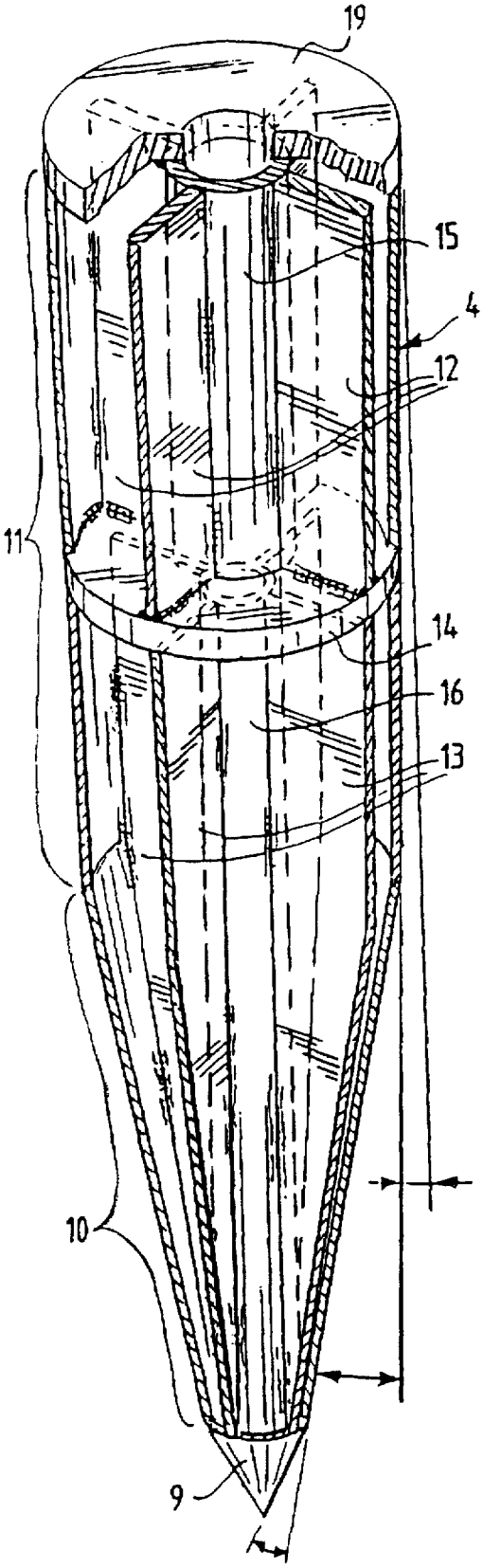
FIG. 2 shows a partly broken away perspective view of a ram tip according to the invention.

FIG. 2 shows the internal structure of the ram tip 4.

The lowest, first portion 9 of the ram tip 4 has a substantially conical shape. Connecting thereto is a second portion 10 with the form of a frustrum cone. The apex angle of this cone is smaller than the apex angle of the first portion 9.

Joining onto this second portion 10 is a third, frustoconical portion 11 which has a smaller apex angle than the second portion 10.

The ram tip 4 is hollow. It is internally reinforced by reinforcing ribs 12 and 13 located respectively above and below a strengthening partition 14.

The ribs 12 extend from an inner tube 15 to the wall of the third portion 11, to which they are fixedly welded, and have a mutual angular distance of approximately 90°. The ribs 13 are correspondingly placed and extend between a slimmer inner tube 16 and the wall of the respective portions 11, 10 and 9.

The tubes 15 and 16 connect onto the partition 14 and in this manner connect the driven top end of the ram tip 4 to the first portion 9, thereby ensuring a very effective transfer of the percussion forces.

The outer surface of the first portion 9 consists of manganese steel, while the outer surfaces of the second portion 10 and the third portion 11 consist of steel-52.

Figure 3:
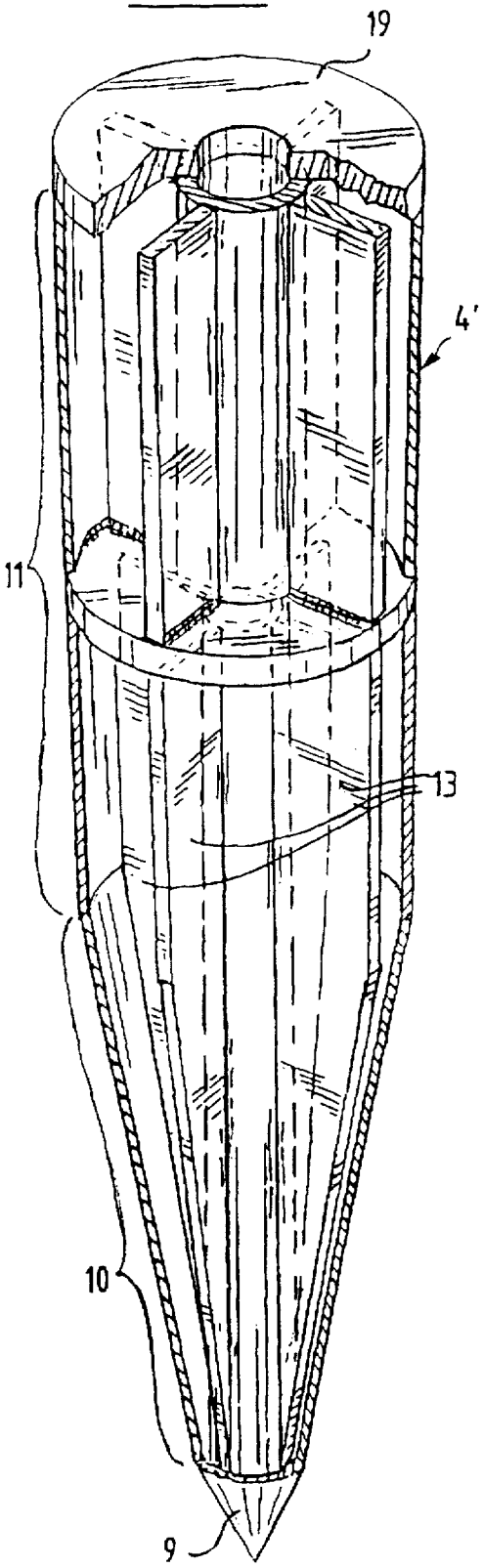
FIG. 3 is a view corresponding with FIG. 2 of a variant.

The ram tip 4' according to FIG. 3 is virtually identical to the ran tip 4 as in FIG. 2. It differs however from the ram tip 4 in the fact that the ribs 13 rest against the wall of the ram tip 4', but are not connected thereto. In this manner the transmission of forces from the top part of the ram tip 4' to the first portion 9 is mechanically separated from the force transmission through the wall of the ram tip 4'. According to circumstances this can result in an even greater effectiveness of the tool.

Figure 4:
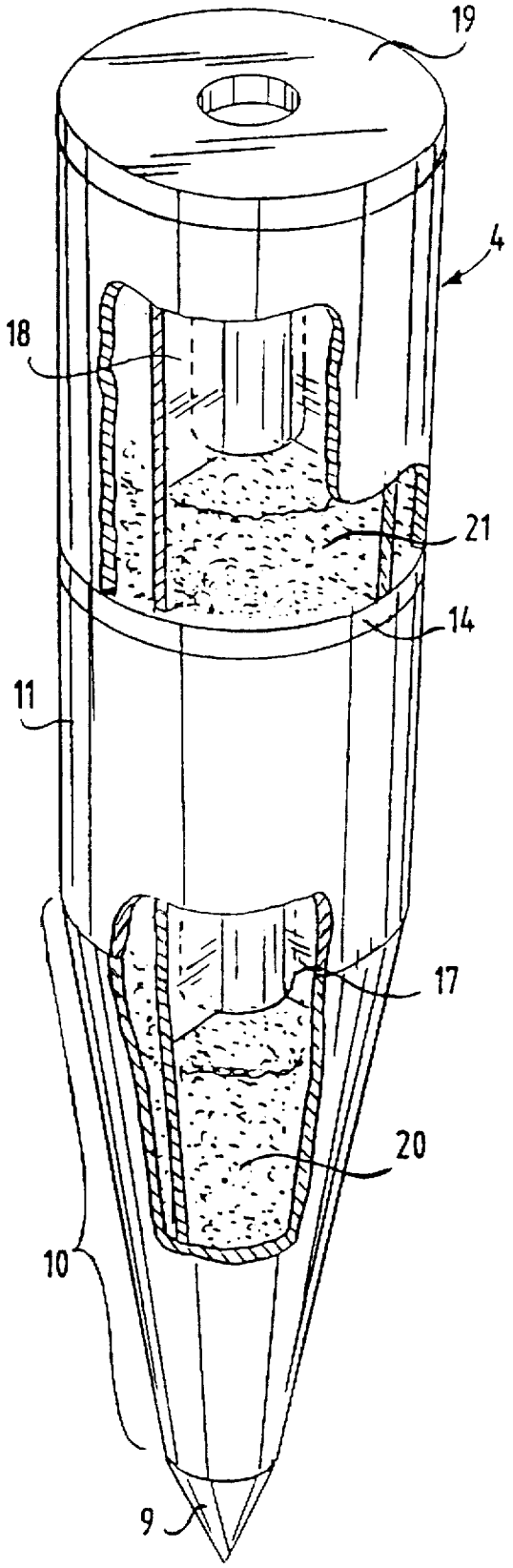
FIGS. 4 and 5 show the ram tip as in FIG. 2 with different fillings of loose material.

FIG. 4 again shows the ram tip 4. In this embodiment it is partially filled with sand. The ram tip 4 comprises two divided spaces, designated 17 and 18 respectively. The space 17 is bounded by the wall of the portions 9, 10, 11 and the partition 14, while the space 18 is bounded by the partition 14, the wall of the upper part of the third portion 11 and the end wall 19. During driving of the ram tip 4 the respective sand masses 20 and 21 are not initially set into motion due to their freedom of movement in the spaces. Owing to their inertia they do however subsequently exert a percussive force. This configuration can also increase the effectiveness of the tool according to the invention.

Figure 5:
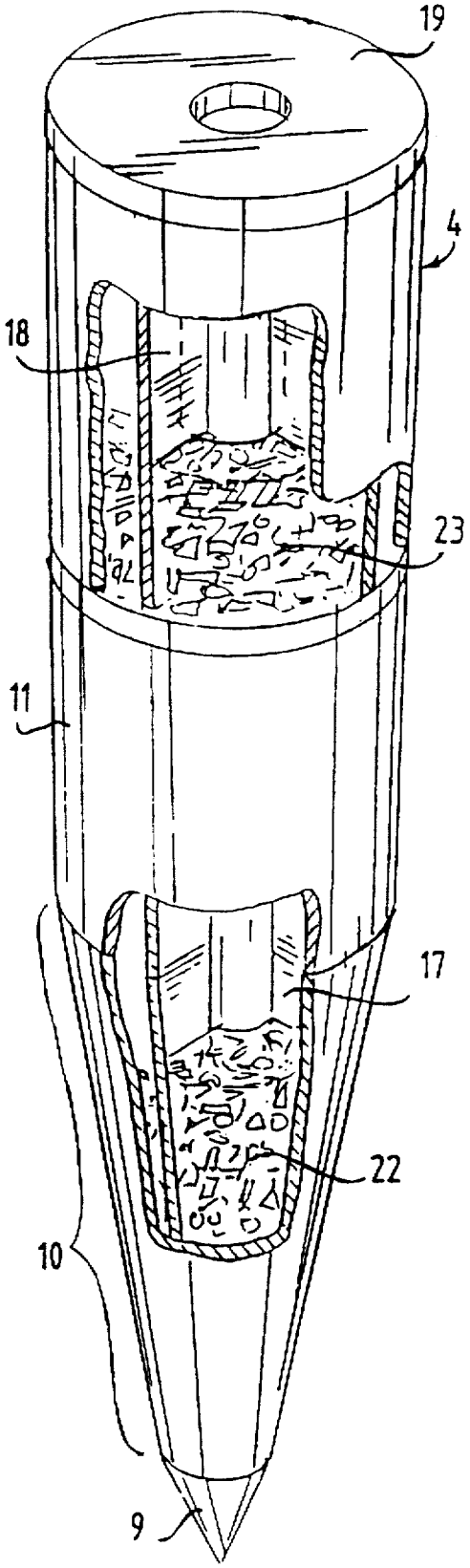

FIG. 5 shows the ran tip 4, wherein however the spaces 17, 18 are partially filled with the respective iron masses 22 and 23. These masses consist of waste material.

Figure 6:
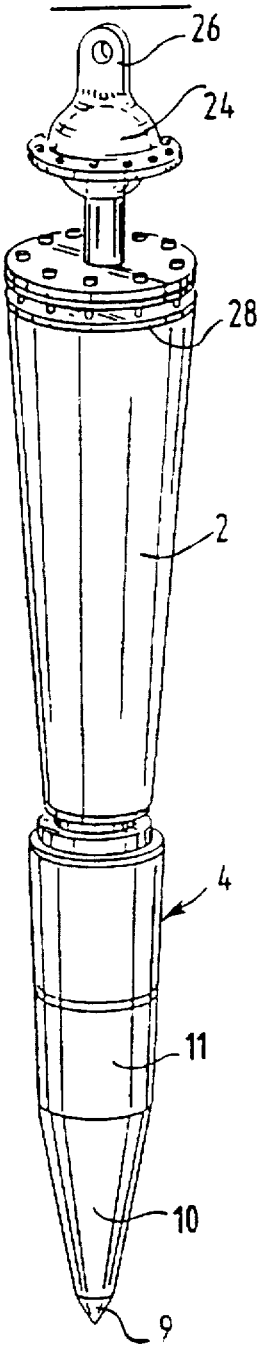
FIG. 6 is a perspective view of a tool which is coupled to a tool driving machine and which can swing in all directions.

FIG. 6 shows the ram tip 4 which is suspended from the tool driving machine 2. By means of a ball and socket joint 24 the tool driving machine 2 can be suspended for free swinging in all directions from fixing ears 25 (see FIG. 1) which form part of the lifting device 1. For this purpose the ball and socket joint is provided at its top with a fixing ear 26.

Figure 7:
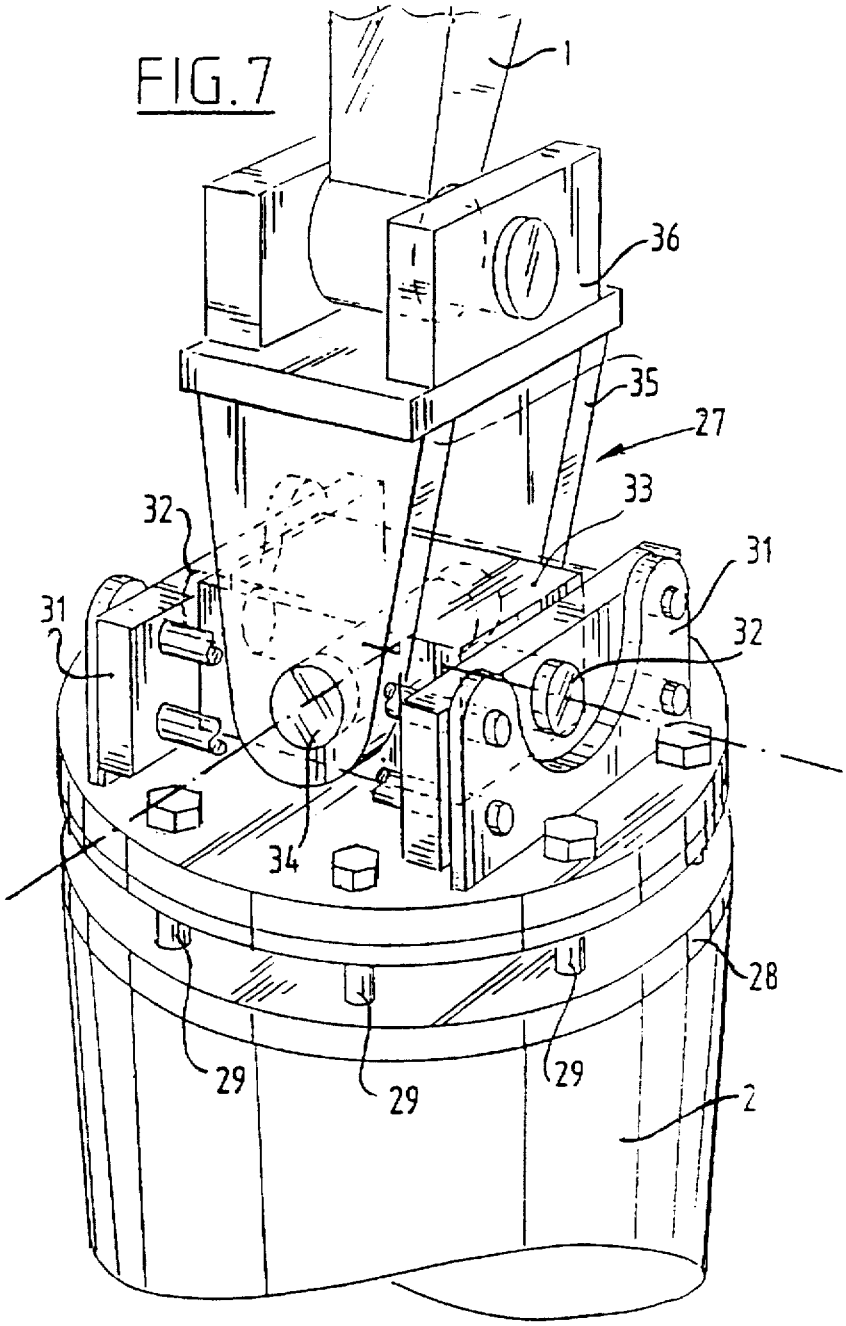
FIG. 7 is a perspective view of a substantially cardan joint.

FIG. 7 shows a substantially cardan coupling 27 with which the tool driving machine 2 is suspended from the lifting device 1. Connected to the upper plate 28 of the tool driving machine 2 by means of a ring of bolts 29 is a coupling plate 30 onto which are fixed two blocks 31. Connected to these blocks 31 by means or pivot shafts 32 is a thus pivotable block 33 through which extends a pivot shaft 34 that is connected to the ears 35 which are in turn connected to a coupling member 36 for coupling to the lifting device 1.

It will be apparent that the described pivoting in two directions will result in the tool driving machine 2, and there with the ram tip 4, 4' carried thereby, being freely swingable in all directions as in the embodiment according to FIG. 6.

Figure 8:
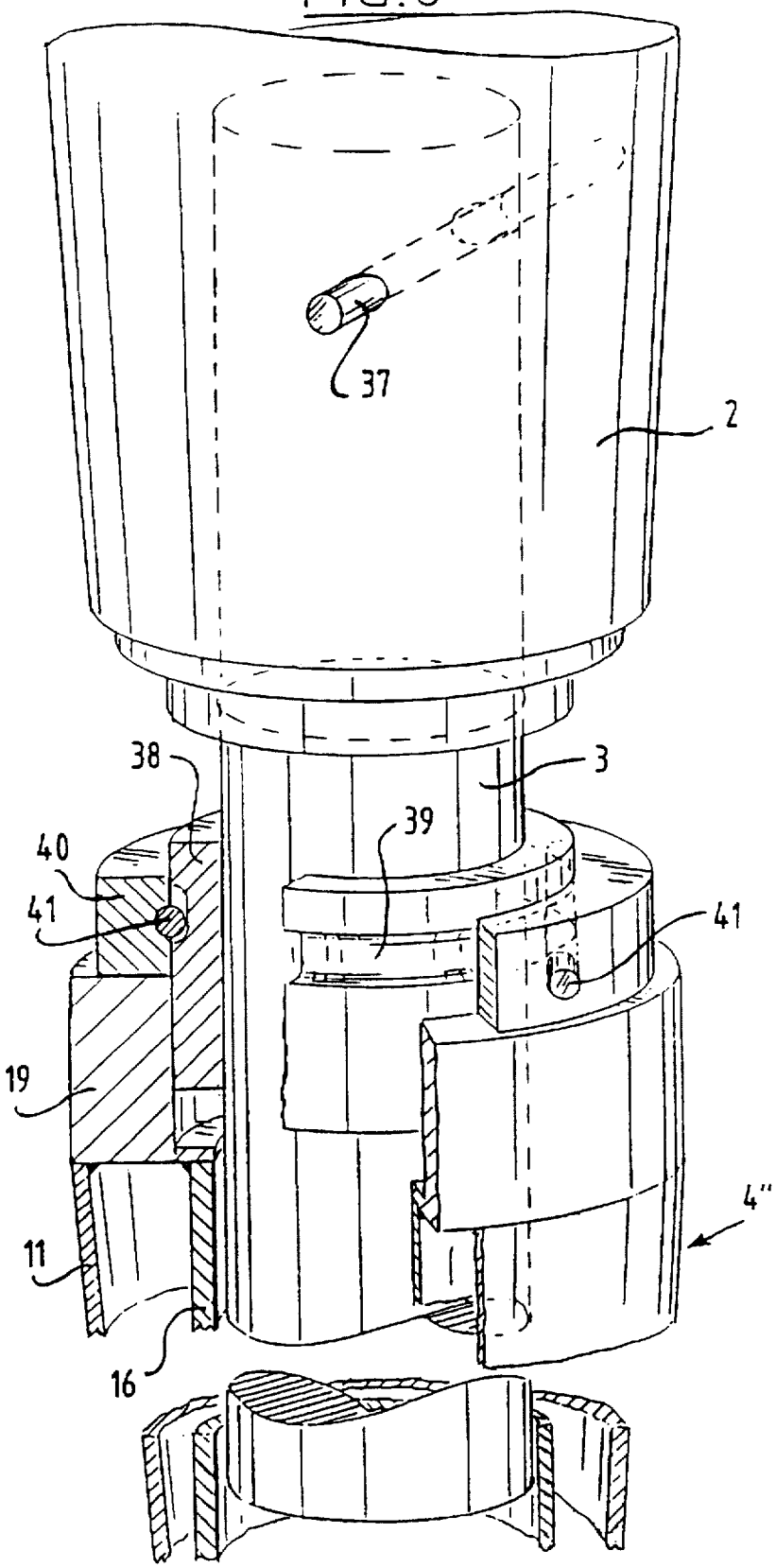
FIG. 8 shows a partly broken away perspective view of the coupling between the tool according to the invention and a tool driving machine.

FIG. 8 shows the manner in which the ram tip 4 can be coupled to the tool driving machine 2.

The tool driving machine 2 carries a chisel 3. This is coupled by means of a coupling pin 37 to a drive means (not shown). An annular coupling block 38 is arranged on the chisel 3 by pressing, shrinking or welding. This coupling block 38 has an annular recess 39. The ram tip 4" bears at its top end a coupling ring 40 which fits round the annular coupling block 38 and is provided with through-holes extending in tangential direction for receiving two coupling pins 41 which, in the inserted position, are situated at a location such that they extend through the annular recess 39. The coupling between the ram tip 4' and the tool driving machine 2 is thus ensured, wherein a certain axial freedom of movement is obtained by an enlarged axial dimension of the recess 39.

Figure 9:
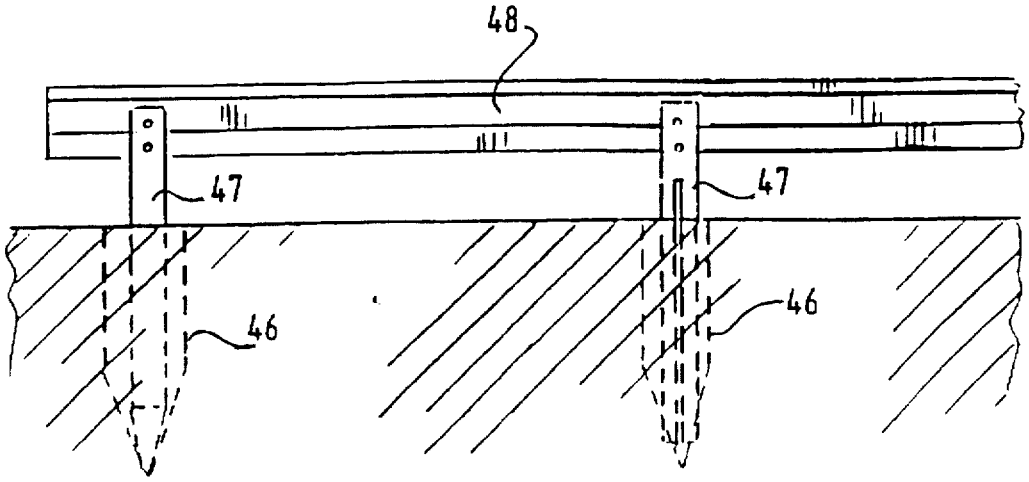
FIG. 9 is a highly schematic side view of a crash barrier supported by foundations manufactured in the manner of the invention.

FIG. 9 shows a schematic side view of a crash barrier 48 which is supported in foundations 46 according to the invention.

FIGS. 10–14 show schematic vertical sections through a hole 42 made in the ground 5 by a ram tip 43.

The depth of the hole 42 is designated with 1/2T. This will be discussed further with reference to FIGS. 13 and 14.

Figure 10:
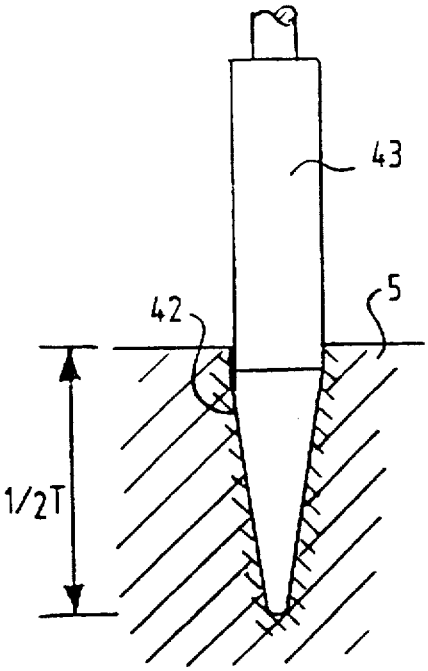
FIGS. 10–14 show schematic sections through the ground and a tool according to the invention in successive stages of manufacturing a foundation in the ground.
Figure 11:
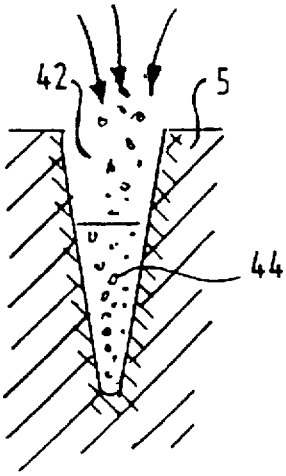

After the hole 42 has been formed in the manner shown schematically in FIG. 10, the ram tip 43 is removed from the hole 42. A concrete mass 44 is then poured into the hole 42. The filling with concrete takes place in this embodiment such that the hole is approximately half filled with concrete.

Figure 12:
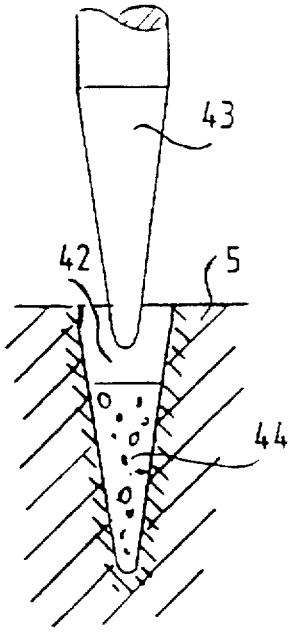
Figure 13:
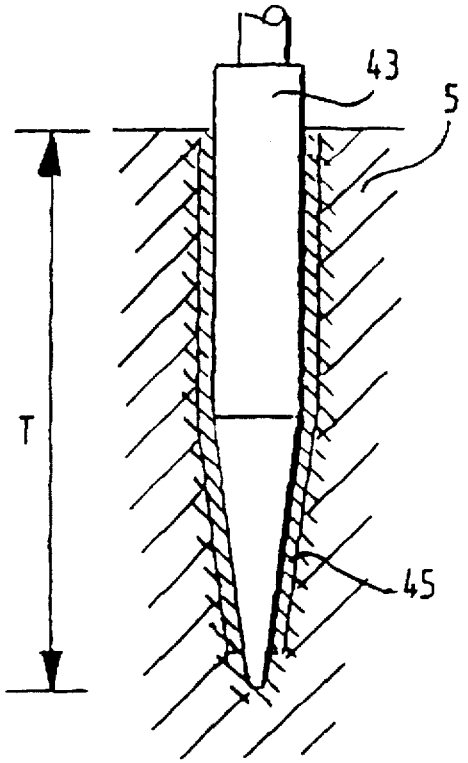

Before the concrete mass 44 has cured the ram tip 43 is replaced in the hole 42 in the manner shown in FIG. 12 and the hole is made longer by appropriate driving of the tool driving machine (not drawn here). During this phase the concrete is distributed along the ram tip 4 so that a tubular concrete casing 45 is created. In this embodiment the total length to be reached equals T. The concrete has also partially penetrated into the ground Material, whereby the casing 45 is firmly anchored in its immediate surrounding area.

Figure 14:
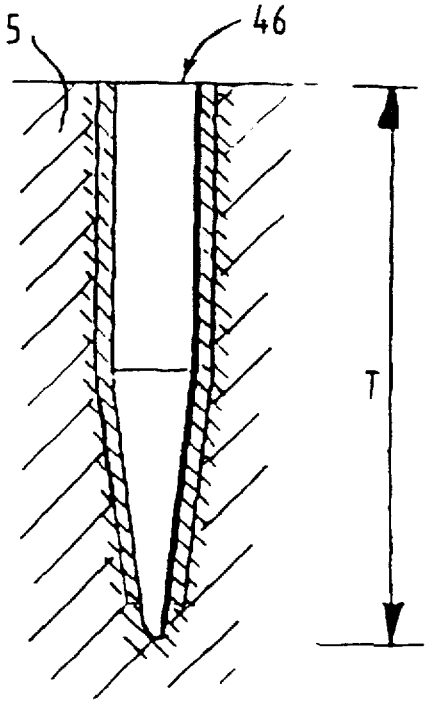

After retracting the ram tip 43 the tubular foundation is completed, as indicated with 46 in FIG. 14.

Figure 15:
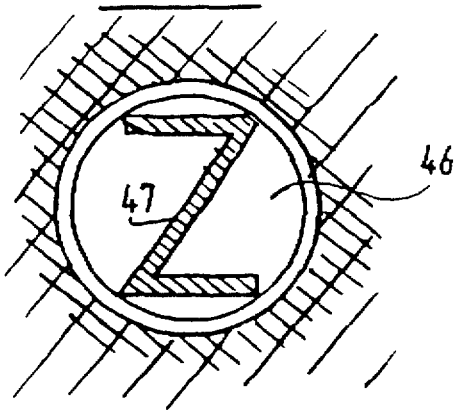
FIG. 15 is a schematic cross section through a foundation in which is arranged a profile supporting pile.

After the concrete casing has cured the supporting pile 47 for the crash barrier 48 is mounted in the obtained foundation 46. As shown in FIG. 15, the supporting pile 47 does not entirely fill the space inside the foundation 46. The remaining space can be filled up for instance with sand or gravel.

Figure 16:
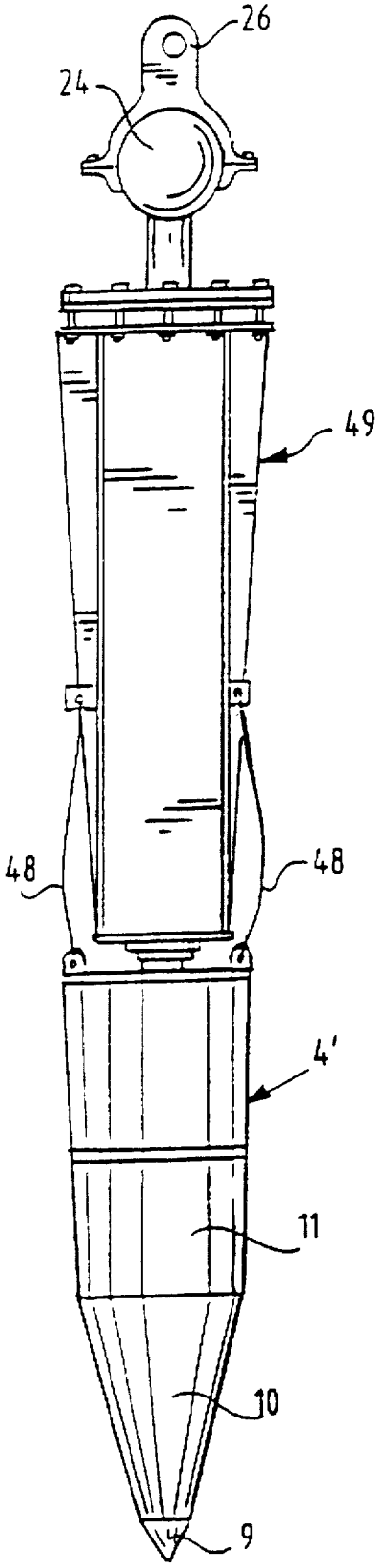
FIG. 16 is a side view of a tool, being coupled for pull resistance with a tool driving machine.
Figure 17:
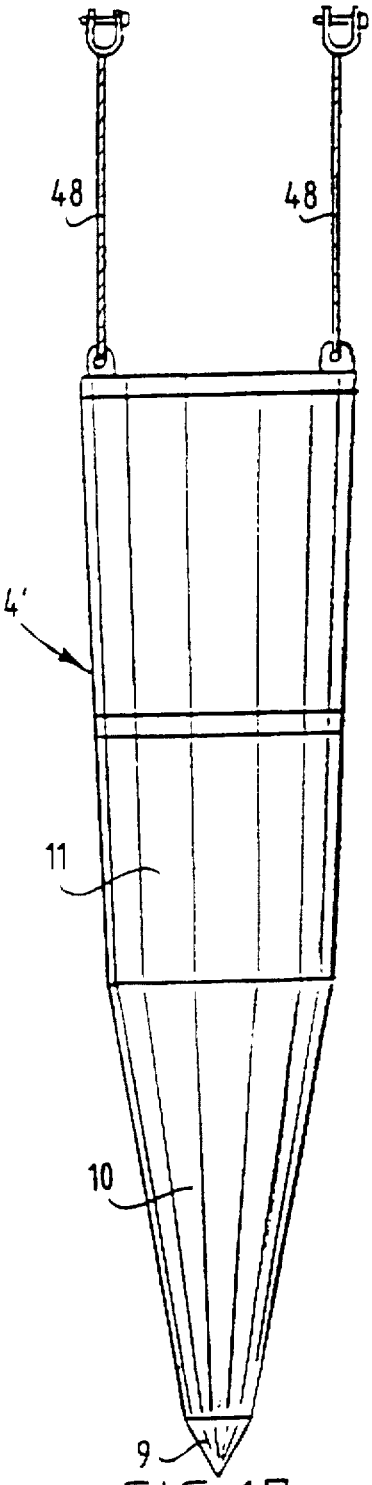
FIG. 17 is a side view of the tool according to FIG. 16 at larger scale.

FIGS. 16 and 17 show a variant, according to which the ramp tip 4' is connected by flexible pull resistant elements, like chains 48, with a tool driving machine 49. These elements 48 serve for lifting up the ram tip 4 out of the hole.

What is claimed is:

1. Method for manufacturing a tubular foundation in the ground comprising the steps of:

(1) providing a tool for making holes in the ground, said tool comprising a ram tip having a free end and coupling means for connecting the ram tip to a drive device;

(2) providing a drive device for successively exciting the ram tip downwardly in the direction of the free end with at least one of vibration and percussion;

(3) coupling the drive device immediately behind the ram tip;

(4) selecting a location for making a hole in the ground;

(5) placing the tool thereat;

(6) setting the drive device into operation such that the tool is excited with at least one of vibration and percussion at a chosen frequency downwardly in the direction of the free end of the ram tip;

(7) penetrating the ground with the ram tip to form a hole;

(8) making the hole having a depth which is smaller than a depth of a tubular foundation to be manufactured;

(9) pulling the ram tip out of the hole;

(10) at least partially filling the hole with pourable concrete;

(11) re-inserting the ram tip in the hole before the concrete has cured;

(12) setting the drive device into operation such that the hole is extended to the desired depth, and the concrete present therein forms a concrete tube round the ram tip and is compacted; and

(13) pulling the ram tip out of the tubular foundation.

2. The method as claimed in claim 1 wherein in step (8) the hole is made having a depth approximately equal to half the depth of the finished tubular foundation.

3. The method as claimed in claim 1 wherein in step (10) the hole is filled to approximately half its depth with pourable concrete.

4. Method as claimed in claim 1, wherein in step (12) the concrete tube is formed such that the concrete extends to a top edge of the hole.

5. The method as claimed in claim 1 further comprising anchoring in the tubular foundation supporting means having an active cross section smaller than a corresponding cross section of the tubular foundation.

6. The method as claimed in claim 5 further comprising placing particulate material around the supporting means in the tubular foundation such that the supporting means is removably anchored.

* * * * *